US005832793A

United States Patent [19]

Collins

[11] Patent Number: 5,832,793

[45] **Date of Patent: *Nov. 10, 1998**

[54] WRENCH WITH TIGHTENING GRIP

[76] Inventor: Matthew L. Collins, P.O. Box 226, San Pedro, Calif. 90733-0226

[ * ] Notice: The terminal 23 months of this patent has been disclaimed.

[21] Appl. No.: 288,354

[22] Filed: Aug. 10, 1994

[51] Int. Cl.[6] ..... B25B 13/22

[52] U.S. Cl. ..... 81/138; 81/408

[58] Field of Search ..... 81/138, 142, 150, 81/151, 152, 407, 408, 409

[56] References Cited

U.S. PATENT DOCUMENTS

| | | | |
|---|---|---|---|
| 389,666 | 9/1888 | Regan | 81/138 |
| 606,317 | 6/1898 | Van Schoick . | |
| 622,197 | 4/1899 | Bayles et al. . | |
| 763,470 | 6/1904 | Erb | 81/138 |
| 795,682 | 7/1905 | Brake | 81/138 |
| 806,425 | 12/1905 | McMillen . | |
| 877,763 | 1/1908 | Deason | 81/142 |
| 0,920,288 | 5/1909 | Dussault | 81/138 |
| 929,504 | 7/1909 | Senter | 81/138 |
| 1,022,520 | 4/1912 | Weatherly . | |
| 1,058,838 | 4/1913 | Allyn | 81/138 |
| 1,166,334 | 12/1915 | Denham . | |
| 1,332,140 | 2/1920 | Norgord . | |
| 1,356,948 | 10/1920 | Weatherly . | |
| 1,409,863 | 3/1922 | Johnson | 81/138 |
| 1,753,224 | 4/1930 | Wagner . | |
| 2,369,346 | 2/1945 | Gearhart . | |
| 2,685,810 | 8/1954 | Wolbaum . | |
| 2,691,317 | 10/1954 | Olson . | |
| 2,817,989 | 12/1957 | Nowak . | |
| 2,882,774 | 4/1959 | Guttfeld . | |
| 3,333,492 | 8/1967 | Chapman . | |
| 4,995,297 | 2/1991 | Richards | 81/138 |
| 5,113,727 | 5/1992 | Foster . | |
| 5,138,912 | 8/1992 | Dyke . | |

FOREIGN PATENT DOCUMENTS

| | | | |
|---|---|---|---|
| 31875 | 10/1910 | Sweden | 81/138 |
| 80268 | 10/1917 | Switzerland | 81/408 |

*Primary Examiner*—Willis Little

[57] ABSTRACT

A unique and novel adjustable wrench including a fixed handle (10) and handle jaw (10C), a movable handle (12), pivoting about a dog (16) and assembled to a slide (18) by a pair of links (24). The wrench features parallel jaws and provides a significant mechanical advantage by multiplying and transferring the operator's force to an object to be held and/or turned. A set of unique holding plates (40 & 42), in the shape of an 'U', attached to fixed handle jaw (10C) and sliding jaw (18) by means of mounting bolts (44 & 46). Holding plates (40 & 42) may be removed and/or reversed, this enables the wrench to be adapted to various work situations including rough plumbing, soft metal, and reverse thread.

4 Claims, 9 Drawing Sheets

WRENCH WITH TIGHTENING GRIP

BACKGROUND—FIELD OF INVENTION

The invention relates to improvements in wrenches.

This invention relates to a hand tool, specifically a wrench with replaceable teeth of simple, strong, and durable design, inexpensive in construction, capable of being quickly adjusted, and will firmly hold a nut, pipe, or other object.

BACKGROUND—DESCRIPTION OF PRIOR ART

There hasn't been a significant product introduced to the hand tool line in the last fifty years. Home repairman and tradesman are still laboring with the basic tools of the trade. Commercially available adjustable tools consist of pipe wrench, pliers, channel-lock, Vise-grips and adjustable wrenches. There are any number of other tools available but they are either specialty tools designed for one job or tools inferior in design and not widely marketed.

The common problem all home repairman and tradesman face with available tools is that they tend to slip or cannot be used in the need position. The pipe wrench, if positioned correctly, will grab and hold to the point of destroying the object. In any other position the pipe wrench is useless. Pliers, channel-locks, and Vise-grips are able to grab and hold most any object in must any position. Due to the non-parallel jaws and the limited holding pressure that can be applied, these wrenches are not able to perform in all applications. Adjustable wrenches, while able to hold a set position, do not have any mechanical advantage associated with moveable jaws. A search of prior art was conducted in Class 81, Subclass 129.5, 134, 150, 184, 355, 356, 359, 360, 409.5, 421, 422, 423, and 427. Examiner Meislin (Class 81) was interviewed during the search.

The following references are believed to be those most pertinent to my wrench which were located during the course of the search:

| Patent No. | Inventor |
|---|---|
| 606,317 | VAN SCHOICK |
| 1,166,334 | DENHAM |
| 2,685,810 | WOLVAUM |
| 1,753,224 | WAGNER |
| 806,425 | McMILLEN |
| 1,022,520 | WEATHERLY |
| 622,197 | BAYLES ET AL |
| 5,113,727 | FOSTER |
| 5,138,912 | DYKE |
| 2,882,774 | GUTRFELD |
| 3,333,492 | CHAPMAN |
| 2,817,989 | NOWAK |
| 2,691,317 | OLSON |
| 1,356,948 | WEATHERLY |
| 1,332,140 | NORGORD |
| 2,369,346 | GERAHART |

U.S. Pat. No. 606,317 is a very old patent directed to a wrench that is capable of firmly gripping a nut or other object. This wrench employs a shank 1 with a stationary jaw 2 having a sliding jaw 3 mounted on it. The sliding jaw 3 consists of a sheet metal casing 4 and a metal block 5 through a toggle link 16 at a rotatable connection. One end of operating level 11 is connected to a dog 10, loosely arranged within the sliding jaw, by a pivot 14.

To operate the wrench of the '317 patent, handle 11 is squeezed toward shank 1 with the nut or other object disposed between stationary jaw 2 and the sliding jaw 3.

This action engages the teeth of dog 10 in the teeth 8 on the side of shank 1. Once engaged pin 14 is immobilized which thereupon serves as a pivot for operating lever 11. As operating lever 11 is squeezed toward shank 1, toggle 16 is counterrotated, thereby pushing block 5 of sliding jaw 3 toward stationary jaw 2. Due to the relative long lever arm of the squeezing handle of operating lever 11, and the relatively short lever arm between pivot 14 and toggle link 16, there is a considerable enhancement of force pushing sliding jaw 3 toward stationary jaw 2 (Table 2).

As with my wrench, a leaf spring 19 is employed to cause the sliding jaw 3 to back away from stationary jaw 2 when handle 11 is released. Unlike my wrench, all operating mechanisms are located on the side of the wrench bearing jaws 2 and 3, rather than on the back side of the shank.

The wrench in patent '317 contains a dog housed within the sliding jaws compared to my wrench which houses the dog within a cavity in the movable handle.

The amount of the force exerted squeezing the two handles is limited to the hand pressure produced by the user. In my wrench the force exerted squeezing the two handles is enhanced by the pulling force exerted to apply torque to the whole wrench. Additionally, the wrench depicted in the '317 patent pushes the sliding jaw, whereas the sliding jaw of my wrench is pulled. Thus, my wrench differs structurally from that depicted in the '317 patent, though the function is similar.

U.S. Pat. No. 1,166,334 discloses a pawl feed type wrench having a stationary jaw 10 carried on a shank 11 with a plurality of ratchet teeth 18 formed on one side. A pawl 17 is pivotally coupled to lever handle 19. Pawl 17 cooperates with ratchet teeth 18 to fix the position of sliding jaw 12 relative to stationary jaw 10, similar to my wrench. Subsequent to engagement of pawl 17 with ratchet teeth 18, displacement of handle lever 19 further towards shank 1 causes counterrotation of link 15 about pivot 16 to push slidable jaw 12 toward stationary jaw 10. A leaf spring 21 serves to maintain the pawl normally in engagement with the ratchet teeth.

The device of the '334 patent, is similar structurally to the wrench of the '317 patent, and is similar functionally to both the wrench of that patent and my wrench. The wrench consist of a handle lever having a bifurcated head crossing a shank where it is pivoted to the shank on the opposite side, whereas the moveable handle of my wrench does not cross the fixed shank and is pivoted on the same side. Again, the amount of the force exerted on the squeezing handle is limited to the hand force produced by the user, where in my wrench the force exerted on the squeezing handle is enhanced by the pulling force exerted to apply torque to the whole wrench (Table 2). Additionally, the wrench depicted in the '334 patent pushes the sliding jaw, whereas the sliding jaw of my wrench is pulled.

U.S. Pat. No. 2,685,810 discloses a link and lever controlled slidable jaw wrench. When an object is to be gripped it is first engaged beneath hook jaw 15 and worm 45 is adjusted appropriately with lever handle 48 rotated out away from main bar 12, as shown in phantom. Handle 48 may then be swung inwardly, causing the linkage defined by members 46 and 49 to be rotated past their dead center positions wherein the head of screw 52 abuts bar 12. This action causes jaw assembly 23 be pushed to tightly engage object 19 (Table 2).

Of particular interest in the '810 patent are the channel shaped jaw elements. As shown, the jaw elements are removable and replaceable and are held in place by transverse bolts 16 and screws 26. Additionally, the wrench depicted in the '810 patent pushes the sliding jaw, whereas the sliding jaw of my wrench is pulled. Although the function of the jaw elements are the same as my wrench, my wrench structure is different.

U.S. Pat. No. 1,753,224 illustrates another wrench having a sliding jaw in which teeth 13 are formed on the back side of body portion 12 of member 1. When the lever is raised and downward pressure exerted at 23, teeth 14 and 13 will disengage, thus allowing jaw 5 to slide along member 4 until jaws 5 and 2 grasp some object. That is, during these conditions there is a slight open space between teeth 13 and 14 that allows slidable jaw 5 to be moved back and forth. Upon removal of manual pressure from point 23, teeth 13 and 14 interlock to create a fulcrum for lever 8. By pressing down on lever 8, head 24 of jaw 5 will be pushed toward jaw 2 and against the intervening nut or pipe. The greater the pressure upon handle 8 the tighter the jaws will lock upon the member being engaged (Table 2).

The wrench of patent '224 consists of a lever handle having an angular bifurcated portion straddling the first shank where it is pivoted to the sliding jaws, whereas the lever of my wrench does not straddle the fixed handle not is it linked directly to the sliding jaws. The jaws of patent '224 are pushed by the handle while the jaws of my wrench are pulled by the link.

U. S. Pat. No. 806,425 shows a wrench having an adjustable jaw. In this reference dog 10 is located on the back side of pole 2 and has teeth 11 that engage ratchet teeth 2', as in my wrench. However, unlike my wrench the force tending to press jaws 3 and 4 together (Table 2) is applied directly by extremity 6' of lever 6, through pivot pin 7, when lever 6 is moved from the position shown in solid lines to that shown in phantom. The placement of pin 7 on the opposite side of shaft 2 to push slide 4.

The wrench of patent '425 consist of a handle with an extension having a pole-passage that pushes the sliding jaws, whereas with my wrench the handle does not have an extension to the other side and the sliding jaws are pulled by a link.

U.S. Pat. No. 2,691,317 appears to develop the highest mechanical advantage of all reviewed wrenches (Table 2). The structural design of patent '317 consists of a threaded shank and nut, whereas my wrench does not use these characteristics and is obviously different.

U.S. Pat. No. 622,197 discloses a pipe wrench with replaceable jaws. Although the function of patent '197 is similar to the function of my wrench the designs are different. The jaws are plates with beveled ends; the inner surface of the jaws being cut away to form a recess having flaring ends. The teeth plates on my design are 'U' shaped.

OBJECTS AND ADVANTAGES

TABLE 2

Comparison with other patents
Approximate Mechanical Advantage Comparison

| Patent Number | Advantage |
|---|---|
| 606,317 | 1:3.56 |
| 622,197 | None |
| 806,425 | 1:3.94 |
| 1,022,520 | 1:4.17 |
| 1,166,334 | None |

TABLE 2-continued

Comparison with other patents
Approximate Mechanical Advantage Comparison

| Patent Number | Advantage |
|---|---|
| 1,332,140 | None |
| 1,356,948 | None |
| 1,753,224 | 1:4.47 |
| 2,369,346 | 1:3.59 |
| 2,685,810 | 1:2.41 |
| 2,691,317 | 1:8.75 |
| My Wrench | 1:20.3 |
| My Plier Version | 1:17.7 |

My wrench, due to the enhanced tightness which the jaws can achieve, allows the user to turn nuts, pipes, or other objects that are worn or damaged. The currently available wrenches cannot match this feature.

The wrench may be use in any orientation to the object. Due to the parallel jaws and the design of the wrench it can grab and hold objects in orientations that can not be achieved by the other available wrenches. For example, the wrench may be position such that the front jaw corner is, holding the edge of a nut while the back jaw corner is holding the flat surface of the nut.

The operator of the wrench is in complete control of the pressure being exerted on the object at all times. If the object is delicate, the operator may apply only enough pressure to hold the item without destroying it. If the operator senses slippage, more pressure can be applied. Due to the high mechanical advantage, the operator can control the work with relatively little effort on his part.

Once the jaws have been set to a desired position, the wrench will continue to return to that relative position as pressure is released from the handles. The ability of the wrench to repeat the setting enables the operator to work quicker than with currently available wrenches.

Unlike a fixed wrench, my wrench is able to hold a nut or object in location while it is being fastened in place. Likewise, the wrench is able to hold objects after the object has been freed. Hand tool such as pliers and Vise-grips can achieve this result but are inferior due to their non-parallel faces.

The opening between the jaws may be changed rapidly whereas some of the currently available wrenches require considerable more time to make the adjustment.

A further feature of my wrench involves reversible and replaceable teeth inserts. In some instances the teeth may be turned in one direction, while in other instances the teeth can be turned in the opposite direction. By providing the teeth as being reversible elements, the direction of incline of the teeth can be changed. This feature enables the wrench to be used for both loosing and tightening of standard and reversed treads objects. Also, different sets of teeth may be desirable for different types of work. That is, teeth inserts with teeth in varying degree of coarseness or fineness may be used interchangeably on the handle and slide.

Still further objects and advantages of my wrench will become apparent from a consideration of the ensuing description and drawings.

Reference Numerals In Drawing

| | | | |
|---|---|---|---|
| 10 | Fixed Handle | 10A | Handle Teeth |
| 10B | Handle Jaw | 10C | Handle Shank |
| 12 | Movable Handle | 14 | Pivot Extensions |
| 16 | Dog | 16A | Dog Teeth |
| 18 | Slide | 18A | Slide Jaw |
| 18B | Slide Housing | 22 | Pivot Pin |
| 20 | Pivot Bolt | 24R | Link - RT |
| 24 | Pair of Links | 32 | Leaf Spring |
| 24L | Link - LT | 42 | Holding Plate - Rear |
| 40 | Holding Plate - Front | 46 | Rear Plate Bolt |
| 44 | Front Plate Bolt | | |

DESCRIPTION—FIGS. 1, 2 AND 3

Figure 1A:
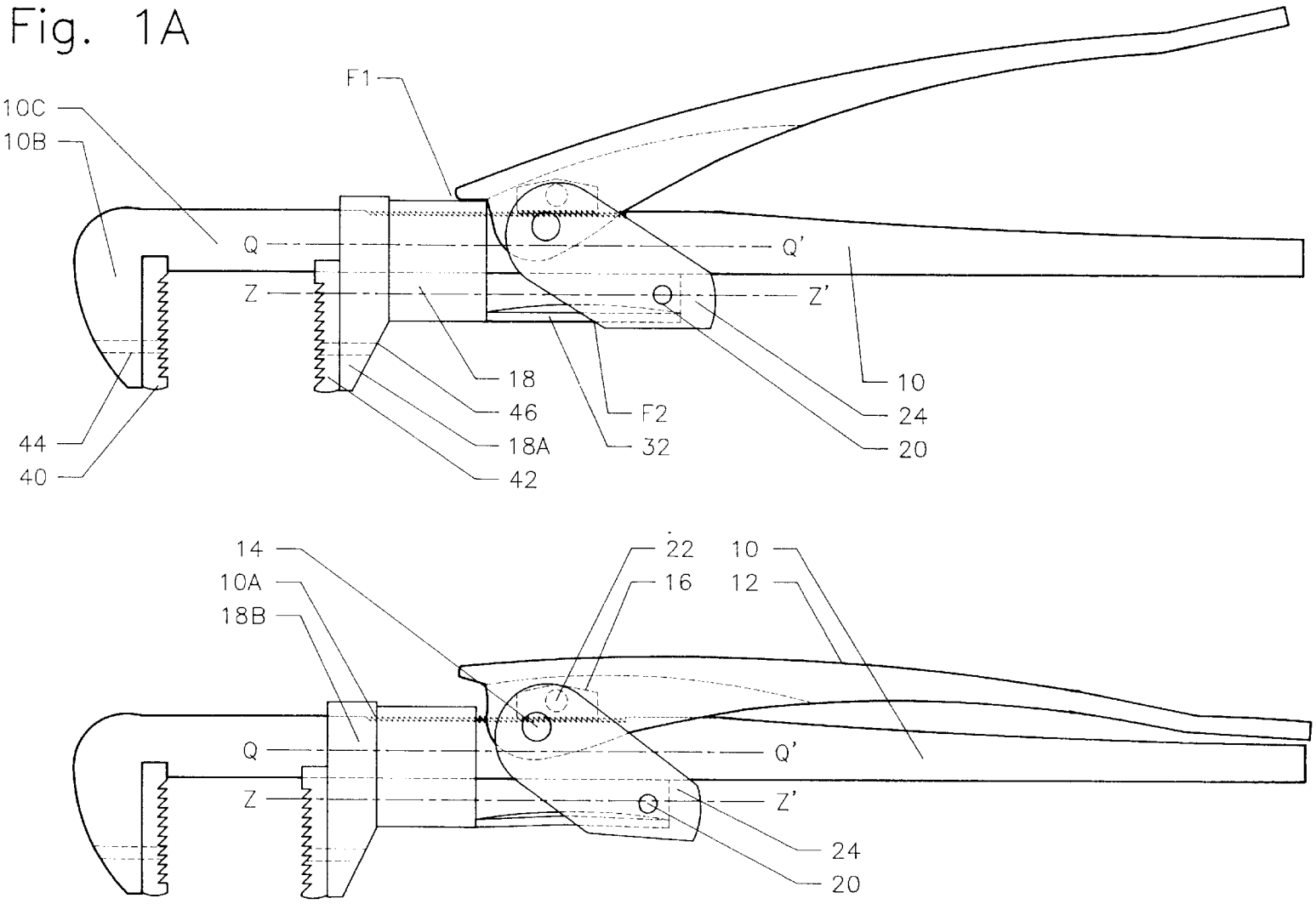
FIG. 1A shows a side view of the assembled wrench comprising the present invention.
Figure 1B:
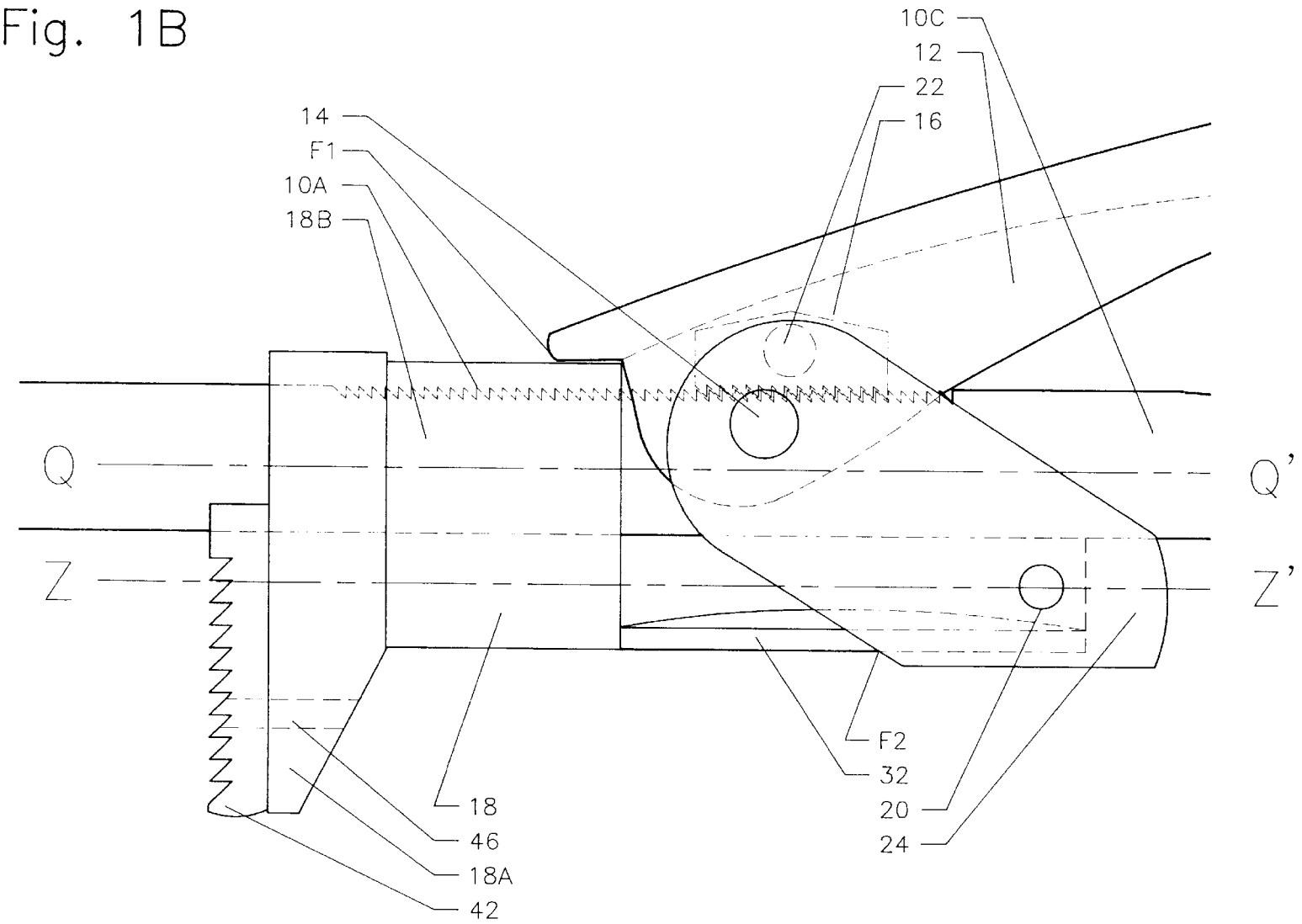
FIG. 1B shows a detailed side view of the slide assembly of the wrench shown in FIG. 1A.
Figure 1C:
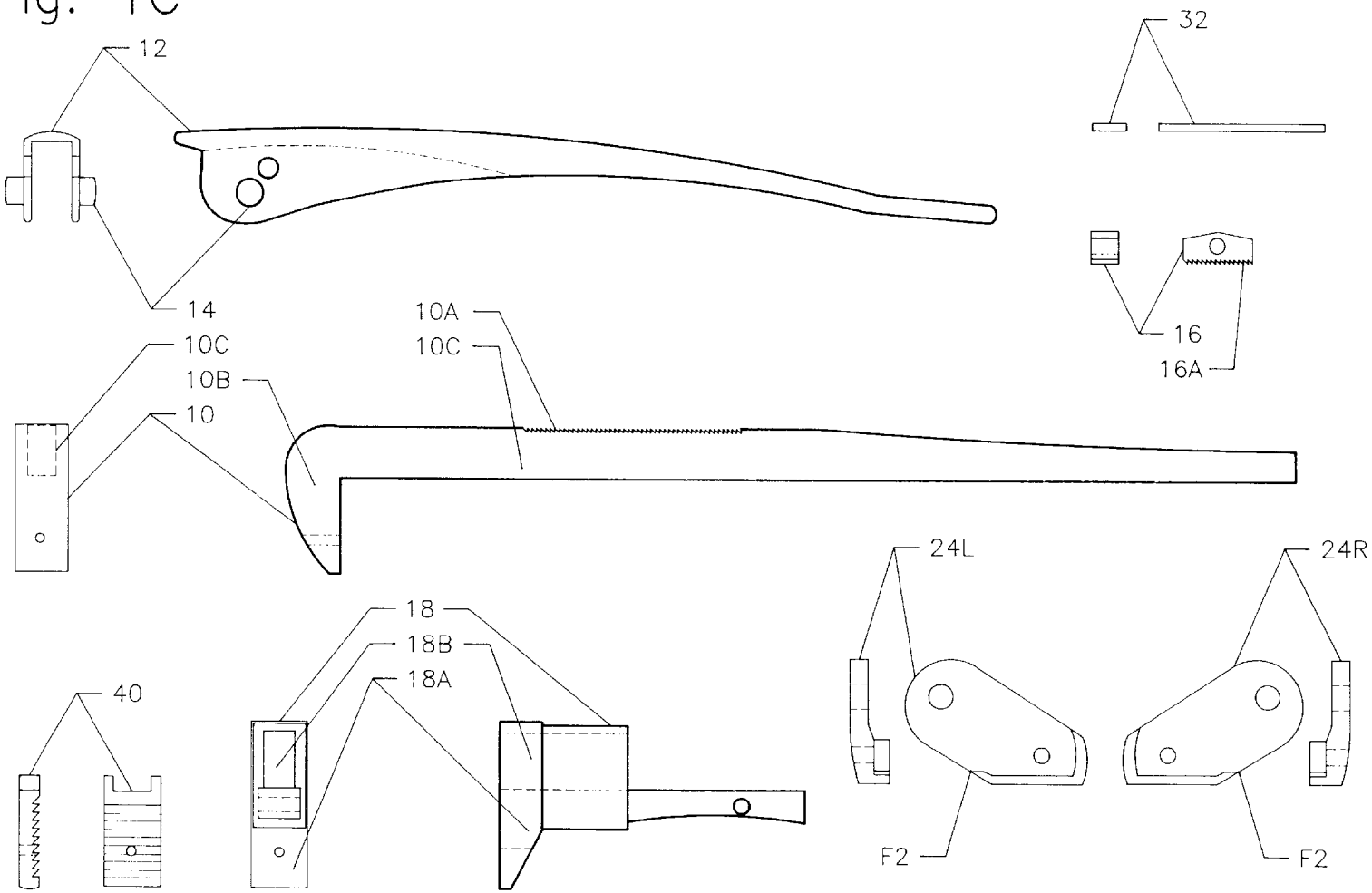
FIGS. 1C and 3C show the unassembled parts of the wrenches comprising the present invention.

With reference to the enclosed FIG. 1, my wrench includes a fixed handle 10 and a movable handle 12. Fixed handle 10 consists of a handle shank 10C at right angles to handle jaw 10B. On the side opposite from the handle jaw 10B is a set of handle teeth 10A. The handle teeth 10A are constructed with a slope from the top edge of the tooth to the bottom angle of the next tooth away from handle jaw 10B. The faces of handle teeth 10A are perpendicular to handle shank 10C. Movable handle 12 is located on the same side as set of handle teeth 10A.

Movable handle 12 has a channel shaped underside that defines a cavity sufficiently large to house a dog 16. Dog 16 has a plurality of ratchet dog teeth 16A on the bottom that are engageable with the set of handle teeth 10A in a rack on the facing side of handle shank 10C. Dog 16 is pivoted to handle 12 by a pivot pin 22 centered in dog 16, remote from dog teeth 16A.

A pair of links 24R and 24L pivot about movable handle 12 at a pivot extensions 14 (left and right) on movable handle 12. Links 24R and 24L are assembled to a slide 18 by a pivot bolt 20. Handle shank 10C is fitted through a slide housing 18B. When assembling slide 18 to the pair of links 24, a leaf spring 32 is positioned between a curved area of slide 18 and the pair of links 24. Leaf spring 32 is under slight pressure. Each end of leaf spring 32 is in contact with curve on slide 18. The middle of leaf spring 32 is in contact with pair of links 24 at point F2.

The placement of the pivot points 22, 20, and 14 are critical to maximizing the mechanical advantage of the wrench. Pins at pivot points 22, 20 and 14 are set to form a right angle at 14 as movable handle 12 rotates half the distance to fixed handle 10 (See FIG. 2A). Proof that the maximum advantage is achieved is demonstrated in Table 1. The distance from 22 to 14 is critical as well as the angle formed by 14 to 20 along axis Z–Z'. The pressure with which the handles are squeezed together is multiplied according to the following formula. (The formula does not take into consideration the effect of friction.)

FIG. 2A

| | | |
|---|---|---|
| Squeeze Pressure | = | $S$ |
| Distance from 22 to point pressure is being applied on Handle 12 | = | $D1$ |
| Distance from 22 to 14 | = | $D2$ |
| Angle axis $Z - Z'$ at 20 to 14 | = | $K$ |
| Angle 22 to 14 to 20 at 14 | = | $K2$ |
| Holding Pressure | = | $\frac{S * D1 * \mathrm{COS}(K) * \mathrm{COS}(K2 - 90)}{D2}$ |

Example: FIG. 2B

| | | | | |
|---|---|---|---|---|
| Squeeze Pressure | = | $S$ | = | 100 lbs |
| Distance from 22 to point pressure is being applied on Handle 12 | = | $D1$ | = | 11.5 inches |
| Distance from 22 to 14 | = | $D2$ | = | .5 inches |
| Angle axis $Z - Z'$ at 20 to 14 | = | $K$ | = | 28 Degrees |
| Angle 22 to 14 to 20 at 14 (Handle half thru arc) | = | $K2$ | = | 90 Degrees |
| Angle 22 to 14 to 20 at 14 (Handle start of arc) | = | $K2$ | = | 97 Degrees |

Minimum Holding Pressure is achieved when the movable handle is at the starting or finishing position.

$$\text{Minimum Holding Pressure} = \frac{100 * 11.5 * \mathrm{COS}(28) * \mathrm{COS}(97 - 90)}{.5}$$

$$\text{Minimum Holding Pressure} = \frac{100 * 11.5 * .8829 * .9925}{.5}$$

Resulting Pressure = 2015.44 lbs.

Maximum Holding Pressure is achieved when the movable handle is half way through the arc.

$$\text{Maximum Holding Pressure} = \frac{100 * 11.5 * \mathrm{COS}(28) * \mathrm{COS}(90 - 90)}{.5}$$

$$\text{Maximum Holding Pressure} = \frac{100 * 11.5 * .8829 * 1}{.5}$$

Resulting Pressure = 2030.67 lbs.

(Resulting Pressure differs from Table results due to rounding.) For a wrench constructed with the above size, the mechanical advantage is approximately 1:20.

TABLE 1

Proofing of 90 degree Maximum Advantage

| | |
|---|---|
| Squeeze Pressure | 100 |
| Distance from 22 to pressure point | 11.5 |
| Distance from 22 to 14 | .5 |
| Angle Handle 12 & 10 at 22 | 14 |
| Angle axis Z-Z' at 20 to 14 | 28 |

| 22-14-20 Angle | Holding Pressure |
|---|---|
| 85 | 2023.052 |
| 85.5 | 2024.519 |
| 86 | 2025.833 |
| 86.5 | 2026.992 |
| 87 | 2027.997 |
| 87.5 | 2028.847 |
| 88 | 2029.543 |
| 88.5 | 2030.084 |
| 89 | 2030.47 |
| 89.5 | 2030.702 |

TABLE 1-continued

| Proofing of 90 degree Maximum Advantage | | |
|---|---|---|
| 90 | 2030.78 | Maximum |
| 90.5 | 2030.702 | |
| 91 | 2030.47 | |
| 91.5 | 2030.084 | |
| 92 | 2029.543 | |
| 92.5 | 2028.847 | |
| 93 | 2027.997 | |
| 93.5 | 2026.992 | |
| 94 | 2025.833 | |
| 94.5 | 2024.519 | |
| 95 | 2023.052 | |

The distance the slide 18 moves along axis Z–Z' is determined by the formula:

```
    Angle formed by rotating
            handle 12 to 10 about pivot 22  =  K1
                   Distance from 22 to 14  =  D2
                   Distance from 20 to 14  =  D3
                 Angle axis Z-Z' at 20 to 14  =  K
Slide Movement=(2*D2*SIN(K1/2)*COS(K)+D3*COS(K))-
          (D3^2-(D3*SIN(K)+2*D2*SIN(K1/2)*SIN(K))^2)^.5
Example: FIG. -- 2A
    Angle formed by rotating
            handle 12 to 10 about pivot 22  =  K1      = 14 Degrees
                   Distance from 22 to 14  =  D2      =    .5 inches
                   Distance from 20 to 14  =  D3      =   2.5
                 Angle axis Z-Z' at 20 to 14  =  K      = 28 Degrees
Slide Movement=(2*.5*SIN(14/2)*COS(28)+2.5*COS(28))-
     (2.5^2-(2.5*SIN(28)+2*.5*SIN(14/2)*SIN(28))^2)^.5
Slide Movement = (1*SIN(7)*COS(28)+2.5*COS(28))-
          (6.25-(2.5*SIN(28)+1*SIN(7)*SIN(28))^2)^.5
Slide Movement = (1*.1219*.8829+2.5*.8829)-
          (6.25-(2.5*.4695+1*.1219*.4695)^2)^.5
Slide Movement = (.1076+2.2073)-(6.25-(1.1738+.0572)^2)^.5
Slide Movement = 2.3149-(6.25-(1.2310)^2)^.5
Slide Movement = 2.3149-(6.25-1.5154)^.5
Slide Movement = 2.3149-(4.7346)^.5
Slide Movement = 2.3149-2.1759
Slide Movement = .1390
```

The following program uses the above formulas to calculate the expected slide movement and the minimum/maximum mechanical advantage for any design specifications.

```
5 REM                                   WRENCH
15 REM                                  12/02/93
25 REM                                M.L. COLLINS
35 REM
45 REM
55 REM *********    SETUP OF CONSTANT TO CONVERT
********************
65 REM *********    RADIAN MEASURE TO DEGREE
********************
75 PI = 3.1415926#
85 C = PI/180
90 REM
91 REM
100 REM **********    ENTER WRENCH DESCRIPTION    ********************
105 CLS                                                    ' CLEAR SCREEN
110 INPUT "Squeeze Pressure..  ";S
115 IF S=0 THEN 710                                  ' ENTER 0 TO END
PROGRAM
120 INPUT "Distance from 22 to pressure point..  "; D1
125 INPUT "Distance from 22 to 14..  "  ;D2
130 INPUT "Distance from 20 to 14..  "  ;D3
135 INPUT "Angle Handle 12 & 10 at 22..  "  ; K1
140 INPUT "Angle axis Z-Z' at 20 to 14..  "  ; K
150 REM   Angle 22 to 14 to 20 at 14 = K2          Calculated
155 K2 = 90 + K1/2
160 REM
200 REM *******       PRINT OUT WRENCH DESCRIPTION
**********************
210 LPRINT "                          Squeeze Pressure..  ";S
220 LPRINT "          Distance from 22 to pressure point..  "; D1
230 LPRINT "                     Distance from 22 to 14..  " ;D2
240 LPRINT "                     Distance from 20 to 14..  " ;D3
250 LPRINT "                 Angle Handle 12 & 10 at 22..  " ; K1
260 LPRINT "                  Angle axis Z-Z' at 20 to 14..  " ; K
270 LPRINT "                   Angle 22 to 14 to 20 at 14..  " ; K2
280 LPRINT #1,
290 REM
295 REM
300 REM ******  CALCULATE AND PRINT SLIDE DISTANCE
***************
310 REM ******  SEE FORMULA DESCRIPTION       Page 13
**********
320 LPRINT "                  Slide Movement.."
;(2*D2*SIN(K1/2*C)*COS(K*C)+D3*COS(K*C))-
(D3^2-(D3*SIN(K*C)+2*D2*SIN(K1/2*C)*SIN(K*C))^2)^.5
```

-continued

```
330 PRINT "                    Slide Movement.."
                                ;(2*D2*SIN(K1/2*C)*COS(K*C)+D3*COS(K*C))-
(D3^2-(D3*SIN(K*C)+2*D2*SIN(K1/2*C)*SIN(K*C))^2)^.5
340 REM
350 REM
400 REM ******  CALCULATE AND PRINT MINIMUM HOLDING PRESSURE
****
410 REM ******  SEE FORMULA DESCRIPTION       Page 11
*******
420 LPRINT "Minimum Holding Pressure.. ";
                                        (D1*S*COS(K1/2*C)*COS(K*C)) / D2
430 PRINT "Minimum Holding Pressure.. ";
                                        (D1*S*COS(K1/2*C)*COS(K*C)) / D2
440 REM
450 REM
500 REM *****   CALCULATE AND PRINT MAXIMUM HOLDING PRESSURE    ****
510 REM *****   SEE FORMULA DESCRIPTION       Page 8
********
520 MP = (D1 * S * COS(K*C)) / D2       ' COS(90) = 1 OMITTED
530 LPRINT "Maximum Holding Pressure.. "; MP
540 PRINT "Maximum Holding Pressure.. "; MP
550 REM
560 REM
600 REM *****     PRINTOUT WRENCH BREAK AND CONTINUE  *************
605 REM *****             TO NEXT WRENCH DESCRIPTION          *************
610 LPRINT #1,
615 LPRINT
"-----------------------------------------------------"
620 LPRINT #1,
625 LPRINT #1,
630 LPRINT #1,
635 INPUT "press ENTER to continue.... ", L$
640 GOTO 105
645 REM
650 REM
700 REM *****     EJECT PAPER AND END PROGRAM ********************
710 LPRINT CHR$ (12)
720 END
```

Following is the output of the program:

Output: FIG. 2B -- Pipe Wrench

| | |
|---|---|
| Squeeze Pressure . . . | 100 |
| Distance from 22 to pressure point . . . | 11.5 |
| Distance from 22 to 14 . . . | .5 |
| Distance from 20 to 14 . . . | 2.5 |
| Angle Handle 12 & 10 at 22 . . . | 14 |
| Angle axis Z-Z' at 20 to 14 . . . | 28 |
| Angle 22 to 14 to 20 at 14 . . . | 97 |
| Slide Movement . . . | 0000.1389904 |
| Minimum Holding Pressure . . . | 2015.643 |
| Maximum Holding Pressure . . . | 2030.78 |

Output: FIG. 2C -- Plier

| | |
|---|---|
| Squeeze Pressure . . . | 100 |
| Distance from 22 to pressure point . . . | 5 |
| Distance from 22 to 14 . . . | .25 |
| Distance from 20 to 14 . . . | 1.0625 |
| Angle Handle 12 & 10 at 22 . . . | 35 |
| Angle axis Z-Z' at 20 to 14 . . . | 26 |
| Angle 22 to 14 to 20 at 14 . . . | 107.5 |
| Slide Movement . . . | .1702012 |
| Minimum Holding Pressure . . . | 1714.39 |
| Maximum Holding Pressure . . . | 1797.588 |

A further feature of my wrench involves removable and replaceable teeth, Holding Plate—Front 40 & Holding Plate—Rear 42. Holding Plate—Front 40 and Holding Plate—Rear 42 can be constructed as an 'U' shaped plate which fits over the handle shank 10C. Holding plates 40 & 42 are attached by holding bolts 44 & 46. In some instances holding plates 40 & 42 will be turned in one direction, while in other instances holding plates 40 & 42 can be turned in the opposite direction. By providing holding plates 40 & 42 as being reversible elements, the direction of incline of the teeth can be changed. Also, different sets of teeth may be desirable for different types of work. That is, teeth inserts with teeth in varying degree of coarseness and fineness may be used interchangeably on handle jaw 10B and slide jaw 18A.

OPERATION—FIGS. 1–3

If the distal end of movable handle 12 is spread away from the distal end of handle shank 10C, movable handle 12 will make contact with slide 18 at a fulcrum point F1. Dog 16 is carried with movable handle 12 by a pivot pin 22, thereby disengaging dog teeth 16A from handle teeth 10A in the rack on the top side of handle shank 10C.

When movable handle 12 is lifted in this manner it also pulls in counterrotation the ears of the pair of links 24. Movable handle 12 and the pair of links 24 are pivoted together at pivot extensions 14. By raising the distal end of movable handle 12 away from handle shank 10C, the upper portion of the ears of the pair of links 24 are pulled in counterrotation by movable handle 12. That is, the pair of links 24 moves in counterrotation about its own fulcrum which is pivot bolt 20. When the pair of links 24 is pulled in counterrotation by movable handle 12, leaf spring 32 is flexed into a bow in the slide 18. With movable handle 12 raised in this manner, the slide assembly, consisting of slide 18, movable handle 12, dog 16, link 24, leaf spring 32, and holding plate—rear 42 can slide along axis Q–Q'. That is, the assembly can slide relative to handle shank 10C. The jaws, handle jaw 10B and slide jaw 18A, can then be moved into contact against the nut, pipe, or object to be turned.

Once holding plates 40 and 42 have been placed in contact with the nut or pipe to be turned or held, movable handle 12 is released from its raised position. This action allows leaf spring 32 to return to its unbiased position, thereby pulling the distal end of movable handle 12 back towards handle shank 10C. With movable handle 12 back in a static position, dog teeth 16A are engaged into handle teeth 10A, thereby providing a fixed fulcrum at 22. At the same time the pair of links 24 is carried by the force of leaf spring 32, in rotation about its pivots 20 and 14. The slide assembly is forced slightly towards handle jaw 10B. This enhances the grip of holding plates 40 and 42 on the nut or pipe.

Figure 2A:
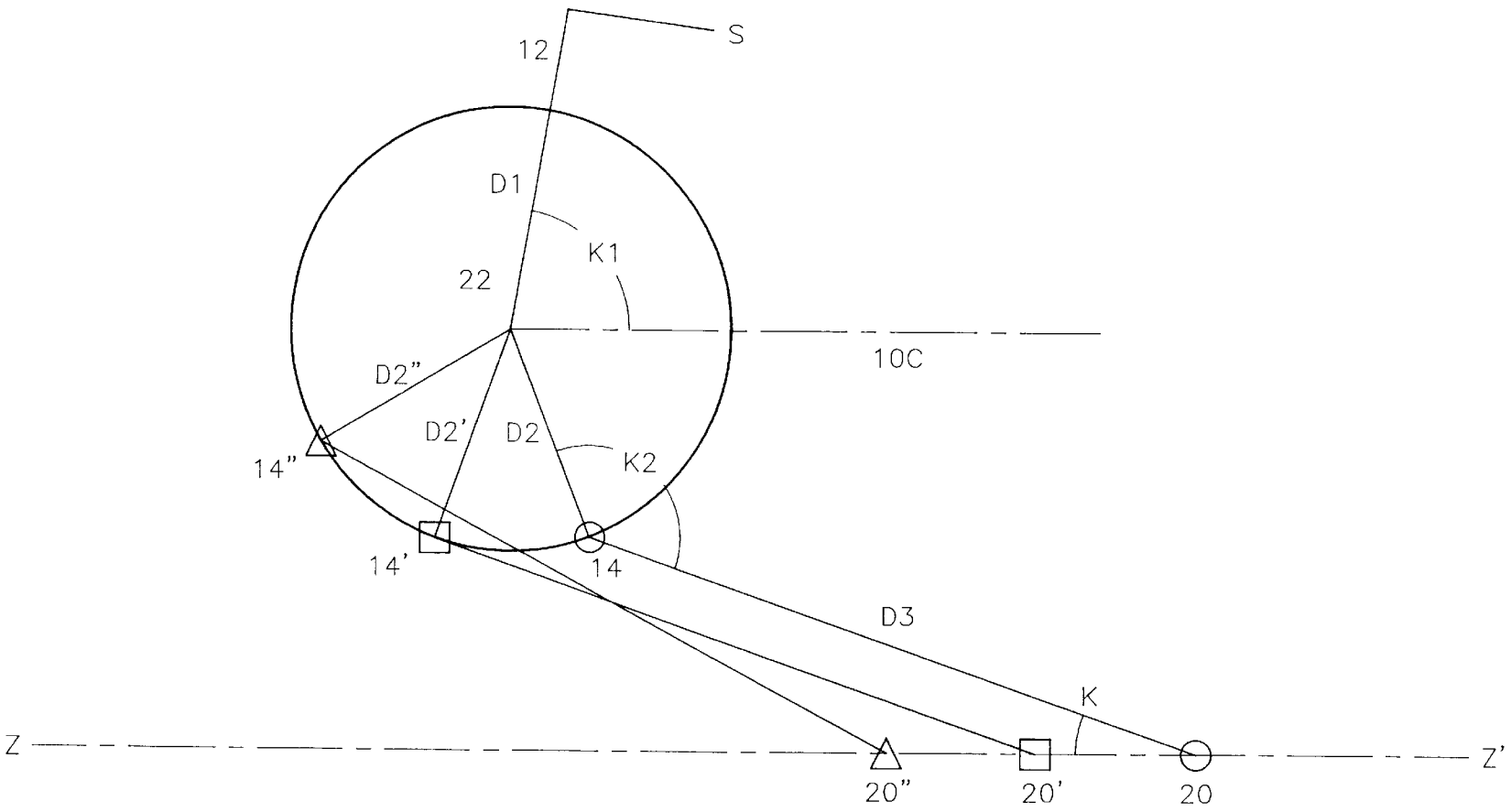
FIGS. 2A–2C show a geometric correlation of the movable components of the present invention as general wrench, pipe wrench, and pliers, respectively.
Figure 2B:
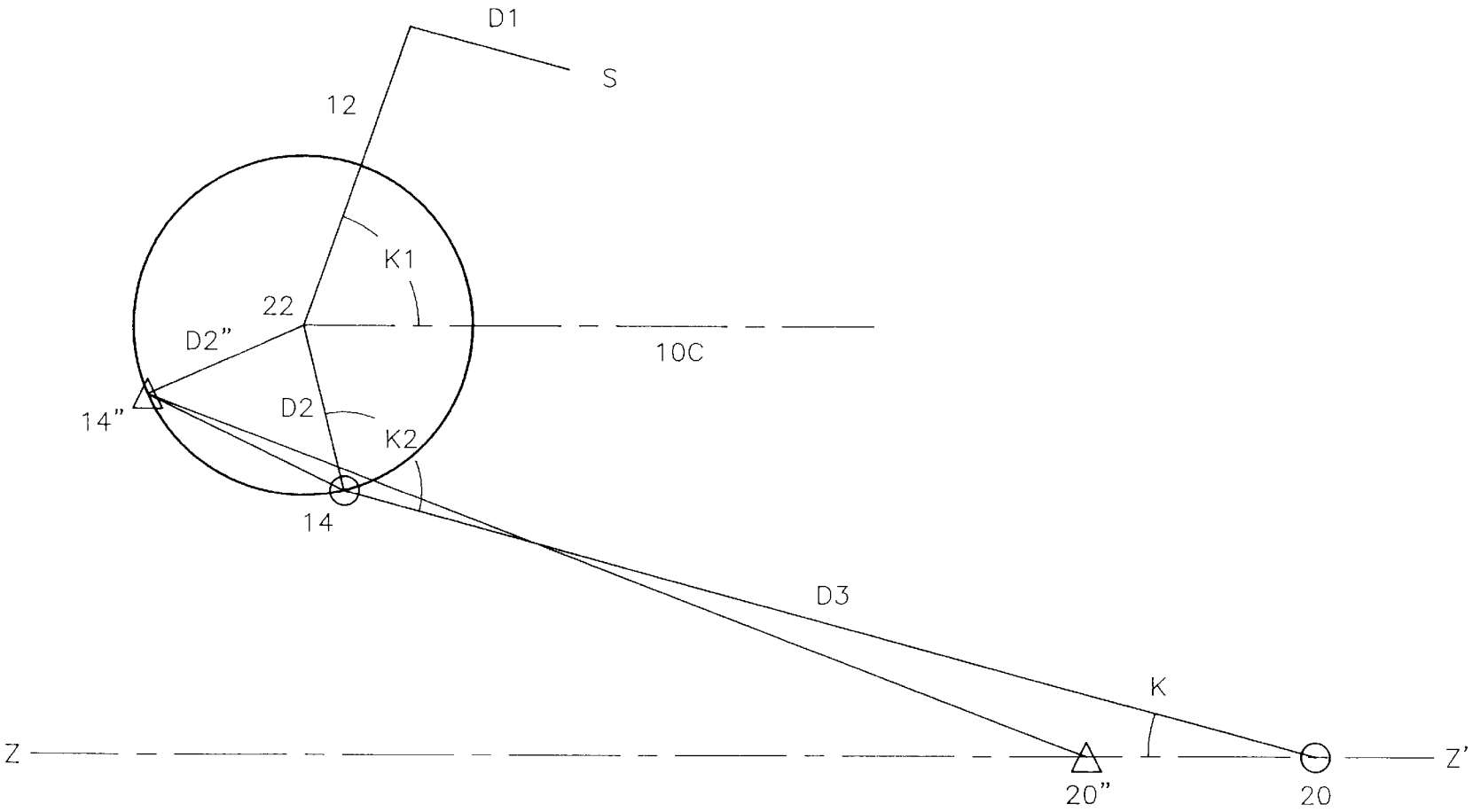
Figure 2C:
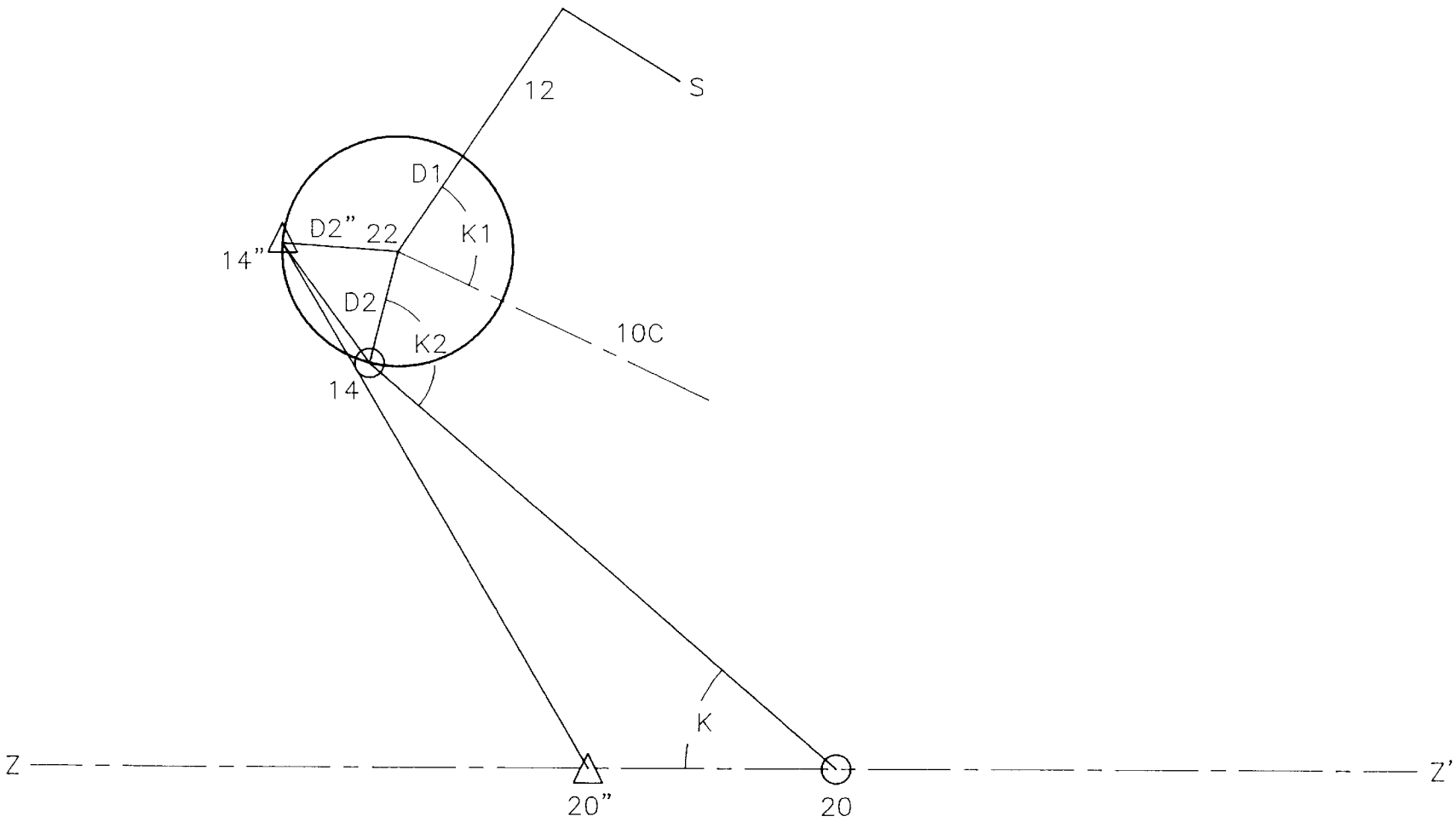

If movable handle 12 is squeezed further relative to handle shank 10C about pivot pin 22, pivot extensions 14 are rotated about pivot pin 22 (See FIG. 2A). As pivot extension 14 rotates, the pair of links 24 rotates about pivot points 14 and 20. As the pair of links 24 rotates it pulls slide 18 along axis Z–Z'.

ASSOCIATED DESIGNS

Figure 3A:
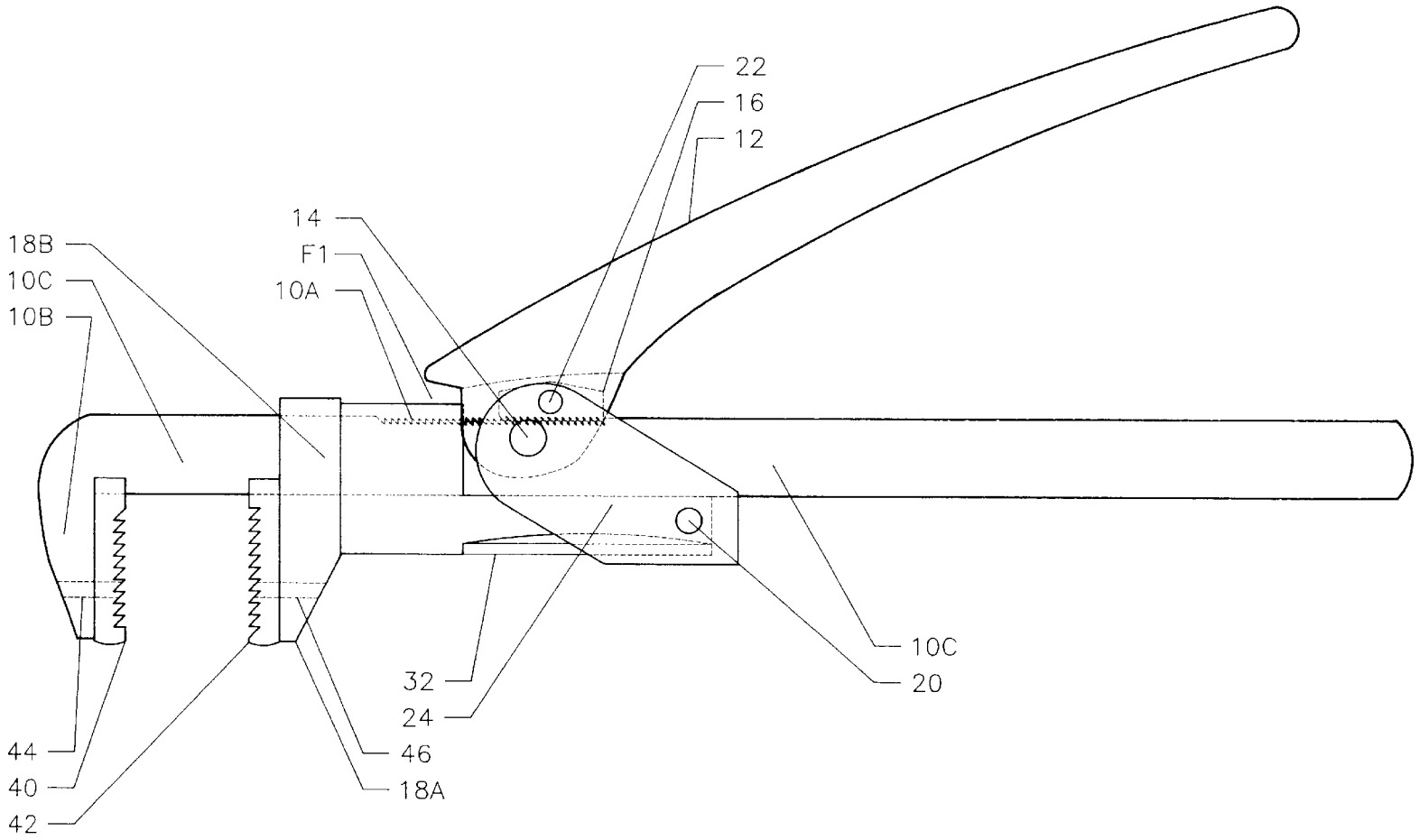
FIGS. 3A and 3B show side views of variations in the design of the assembled wrench comprising the present invention as pliers and needle nose pliers, respectively.
Figure 3B:
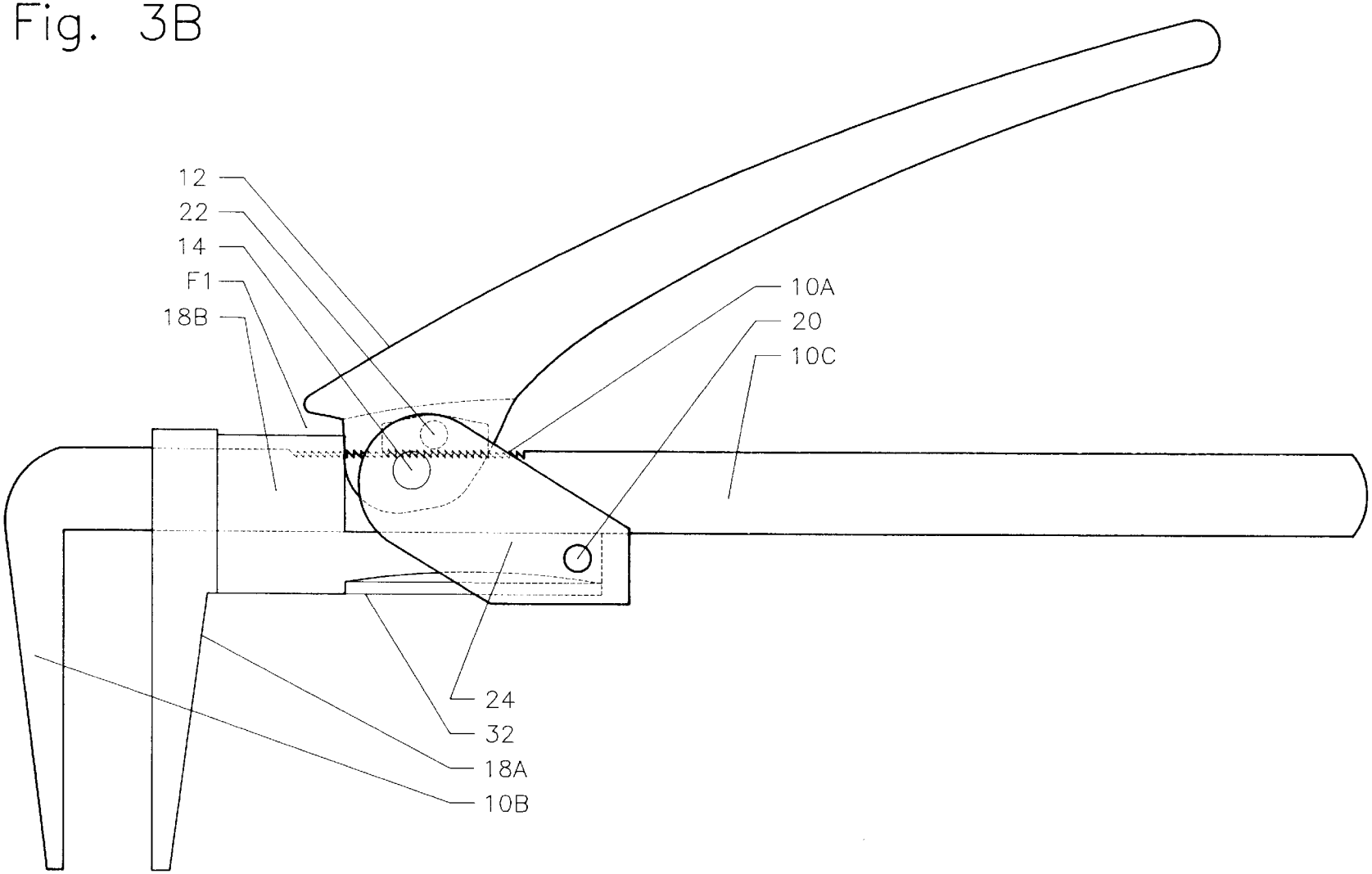
Figure 3C:
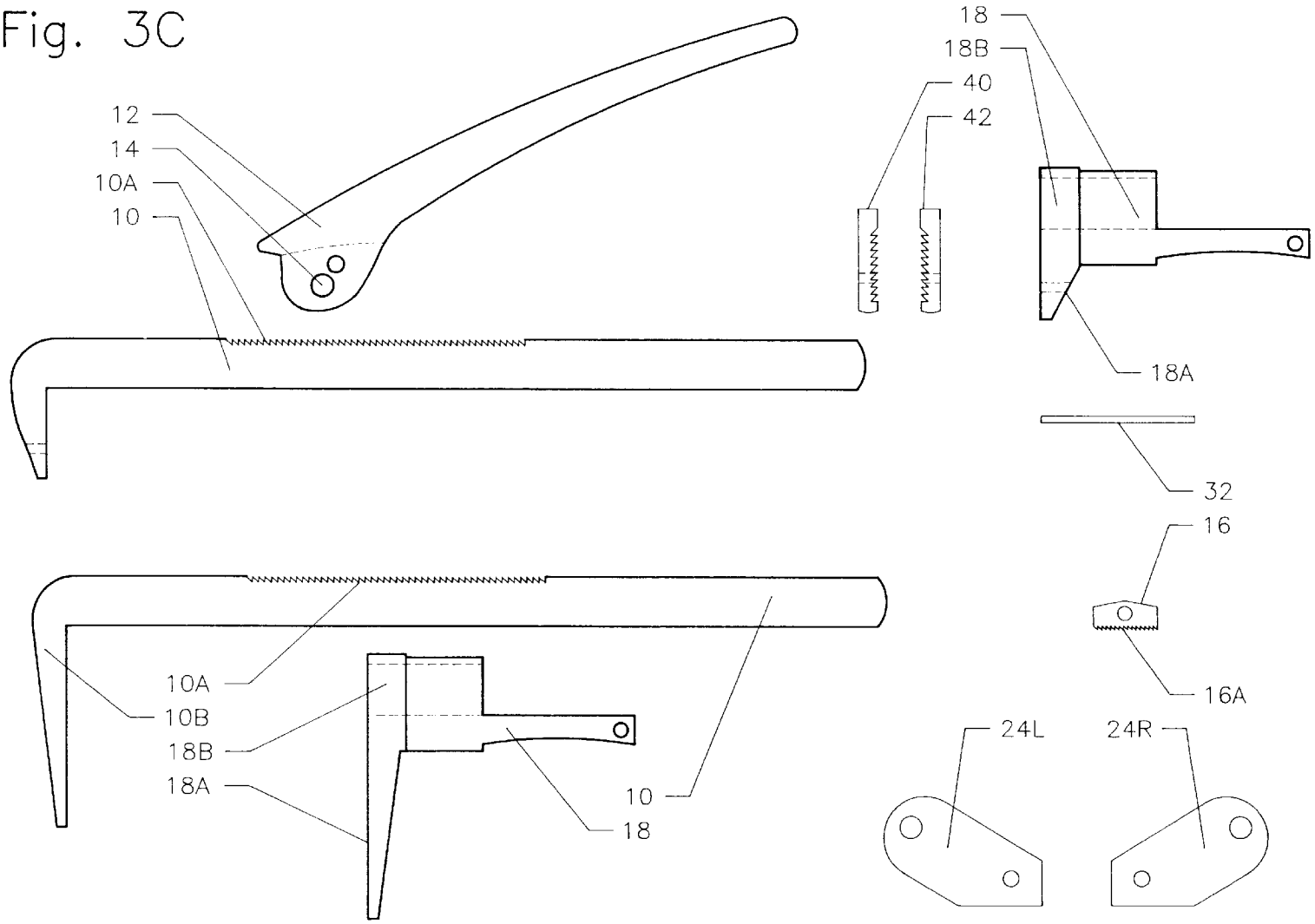

The configuration of my wrench as presented is as a pipe wrench. With modifications to the handles and jaws my wrench is readily configured to pliers (FIG. 3A) or needle nose pliers (FIG. 3B) using the same principles and features. The construction and operation of these tools is exactly the same. The parts of the tools, FIG. 3C, have been altered in size, pin location and shape but still function as described. Note that the teeth inserts are not featured on the needle nose pliers FIG. 3B. In some cases the holding teeth will be machined into the jaws.

SUMMARY

As can be seen, my wrench is a unique structural arrangement of elements which achieve the following features:

a. a superior mechanical advantage for tightening the grip of jaws on nuts, pipes, or other objects, b. capable of being used in any position with the ability to hold onto any part of the object, c. returns to set position after pressure is released enabling operator to continue work without resetting tool, d. able to hold object in place during assembly or to hold object until disassembly has been completed, e. assembled with removable, reversible, and replaceable parallel teeth sets to match work requirements, f. able to quickly adjust the wrench to fit any size nut, bolt, pipe, or other object for holding or turning, enables operator to control work while applying force, and g. provides operator complete control of pressure being exerted on object thereby reducing or eliminating chance of destroying object.

Although the description above contains many specificities, these should not be construed as limiting the scope of my wrench but as merely providing illustrations of some of the presently preferred embodiments of this wrench. For example, the pin alignment as defines is required to maximize the mechanical advantage, but other alignments provide similar results. Also, my wrench as described, refers to a hand held tool, but the design could be incorporated into a mounted or a powered driven device.

Thus the scope of my wrench should be determined by the appended claims and their legal equivalents, rather than by the examples given.

What is claimed is:

1. A mechanical device, comprising:

a. a fixed handle combining a fixed jaw, a handle shank and a set of handle teeth, said fixed jaw is at an angle to said handle shank with said set of handle teeth on the side of said handle shank opposite from said fixed jaw, b. a slide combining a slide jaw and a slide housing, said slide housing capable of receiving said handle shank, said slide jaw at the same relative angle as formed by said fixed jaw and said handle shank, said slide having a hole on the end opposite said slide jaw, c. a movable handle with a channel shaped cavity and a set of pivot extensions, said movable handle assembled on the same side as said set of handle teeth, said movable handle having a hole position near said set of pivot extensions, d. a pair of links secured to said slide by a pivot bolt and pivoted about said movable handle at said set of pivot extensions, e. a dog with dog teeth, loosely fitted within said movable handle cavity by a pivot pin, f. a leaf spring positioned between said slide and said pair of links, means for maintaining a set position while said movable handle is in a static position.

2. The mechanical device of claim 1, means for returning said leaf spring to position after rotation of said movable handle away from said fixed handle thereby removing said dog teeth from contact with said set of handle teeth, enabling the said slide jaw to be moved relative to an object to be held and said handle jaw.

3. The mechanical device of claim 1 further comprising, means for returning said leaf spring to position after rotation of said movable handle towards said fixed handle thereby rotating about said dog pivot enabling the movement of said slide jaw towards said fixed handle jaw and object to be held with amplified force.

4. The mechanical device of claim 1 wherein a set of holding plates, with a notch enabling the receiving of said handle shank, with threaded holes capable of matching a set of bolts through holes of either said fixed jaw or said sliding jaw, means for allowing the interchange of said holding plates.

* * * * *